US011112728B2

(12) United States Patent
Cho et al.

(10) Patent No.: US 11,112,728 B2
(45) Date of Patent: Sep. 7, 2021

(54) STRUCTURE FOR SELECTIVELY LOCKING TONER INLET SHUTTER OF TONER REFILL PORTION BASED ON ROTATIONAL PHASE OF TONER REFILL CARTRIDGE

(71) Applicant: HEWLETT-PACKARD DEVELOPMENT COMPANY, L.P., Spring, TX (US)

(72) Inventors: Yong-Kwan Cho, Uiwang-si (KR); Woong-Yong Choi, Yongin-si (KR)

(73) Assignee: HEWLETT-PACKARD DEVELOPMENT COMPANY, L.P., Spring, TX (US)

( * ) Notice: Subject to any disclaimer, the term of this patent is extended or adjusted under 35 U.S.C. 154(b) by 0 days.

(21) Appl. No.: 17/051,084

(22) PCT Filed: Apr. 30, 2019

(86) PCT No.: PCT/US2019/029967
§ 371 (c)(1),
(2) Date: Oct. 27, 2020

(87) PCT Pub. No.: WO2020/046430
PCT Pub. Date: Mar. 5, 2020

(65) Prior Publication Data

US 2021/0232064 A1 Jul. 29, 2021

(30) Foreign Application Priority Data

Aug. 30, 2018 (KR) ..... 10-2018-0102543

(51) Int. Cl.
*G03G 15/08* (2006.01)
*G03G 21/16* (2006.01)

(52) U.S. Cl.
CPC ..... *G03G 15/0886* (2013.01); *G03G 21/1652* (2013.01); *G03G 21/1676* (2013.01)

(58) Field of Classification Search
CPC ..... G03G 15/0886; G03G 21/1652; G03G 21/1676; G03G 2215/0692
See application file for complete search history.

(56) References Cited

U.S. PATENT DOCUMENTS 5,089,854 A 2/1992 Kaieda et al.
5,848,338 A 12/1998 Okada
(Continued)

*Primary Examiner* — Sandra Brase
(74) *Attorney, Agent, or Firm* — Staas & Halsey, LLP

(57) ABSTRACT

A printer includes a main body, a development cartridge attachable to and detachable from the main body, the development cartridge to supply toner contained in a toner container to an electrostatic latent image formed on a photoconductor, to form a visible toner image, a mounting portion including a toner inlet portion connected to the toner container, where a toner cartridge usable to refill toner in the toner container is mountable to the mounting portion, an inlet shutter rotatably provided in the mounting portion to be rotatable together with the toner cartridge, the inlet shutter rotatable between a blocking position to block the toner inlet portion from receiving toner and an inlet position to open the toner inlet portion to receive toner, a locking unit to selectively lock and unlock the inlet shutter, and a controller to control the locking unit to selectively lock and unlock the inlet shutter based on whether the toner cartridge is mounted to the mounting portion.

15 Claims, 12 Drawing Sheets

(56) References Cited

U.S. PATENT DOCUMENTS

| | | | | |
|---|---|---|---|---|
| 6,249,654 | B1 | 6/2001 | Kurz et al. | |
| 6,266,506 | B1 | 7/2001 | Kurz et al. | |
| 9,164,421 | B2 | 10/2015 | Hayashi et al. | |
| 2004/0009006 | A1 | 1/2004 | Yamada et al. | |
| 2004/0190945 | A1 | 9/2004 | Yamada | |
| 2005/0147428 | A1 | 7/2005 | Yamada | |
| 2006/0104673 | A1* | 5/2006 | Sasae ..... | G03G 15/0886 399/262 |
| 2009/0297226 | A1* | 12/2009 | Nagashima ..... | G03G 21/1676 399/258 |
| 2010/0329747 | A1 | 12/2010 | Kouda | |
| 2016/0246252 | A1 | 8/2016 | Minoshima | |
| 2016/0313670 | A1* | 10/2016 | Eto ..... | G03G 15/0886 |

* cited by examiner

STRUCTURE FOR SELECTIVELY LOCKING TONER INLET SHUTTER OF TONER REFILL PORTION BASED ON ROTATIONAL PHASE OF TONER REFILL CARTRIDGE

CROSS REFERENCE TO RELATED APPLICATIONS

This application is filed under 35 U.S.C. § 371 as a National Stage of PCT International Application No. PCT/US2019/029967, filed on Apr. 30, 2019, in the U.S. Patent and Trademark Office, which claims the priority benefit of Korean Patent Application No. 10-2018-0102543, filed on Aug. 30, 2018, in the Korean Intellectual Property Office. The disclosures of PCT International Application No. PCT/US2019/029967 and Korean Patent Application No. 10-2018-0102543 are incorporated by reference herein in their entireties.

BACKGROUND

A printer using an electrophotographic method is a printer in which toner is supplied to an electrostatic latent image formed on a photoconductor to form a visible toner image on the photoconductor, and the toner image is transferred via an intermediate transfer medium or directly to a print medium and then the transferred toner image is fixed on the print medium.

A development cartridge contains the toner, and supplies toner to the electrostatic latent image formed on the photoconductor to form a visible toner image. When the toner contained in the development cartridge is used up, the development cartridge is removed from a body of the printer, and a new development cartridge may be mounted on the main body. The development cartridge may also be refilled with a new toner by using a toner refill kit (toner refill cartridge).

DETAILED DESCRIPTION

Figure 1:
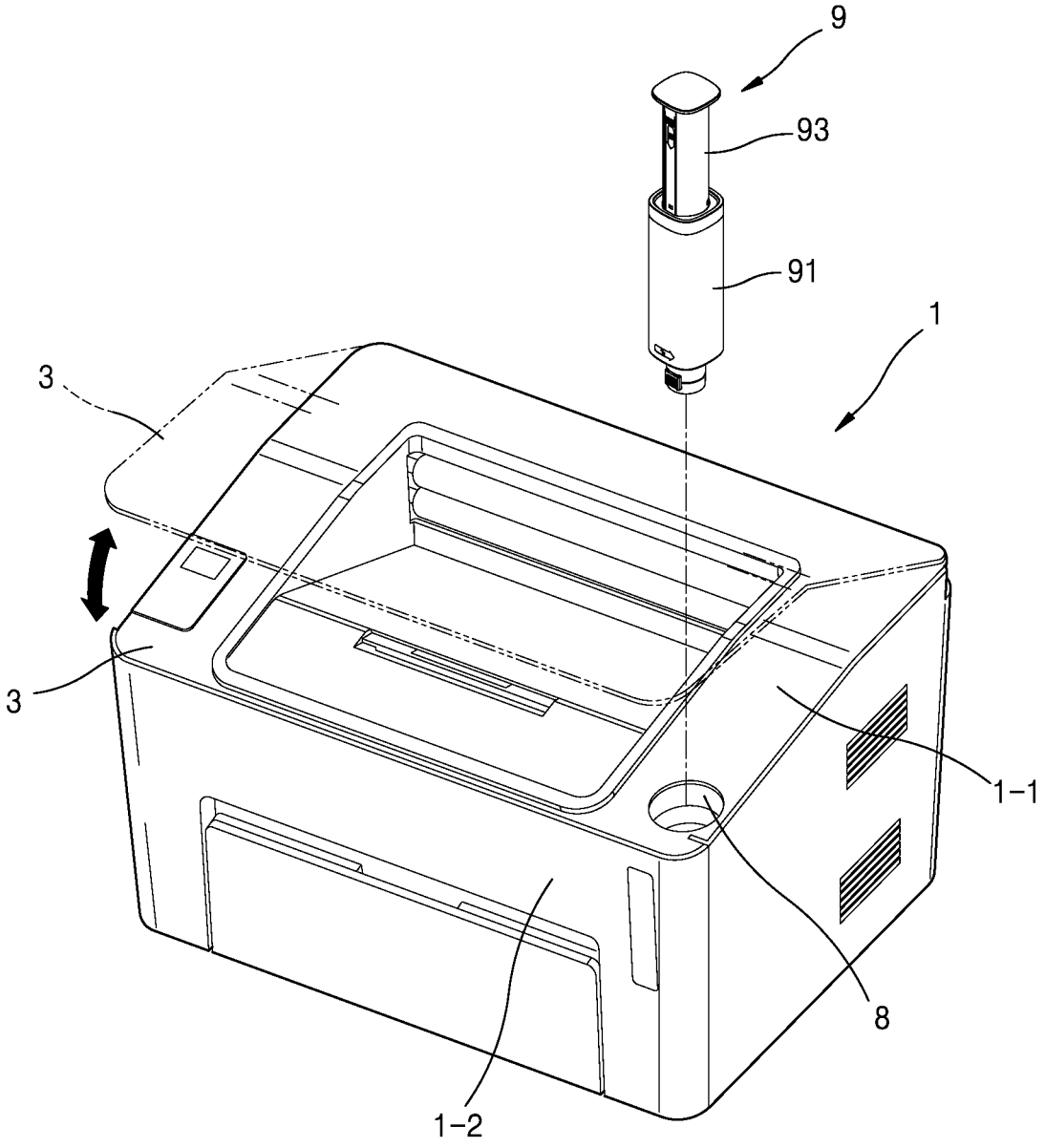
FIG. 1 is a schematic perspective view of the exterior of an electrophotographic printer according to an example.

FIG. 1 is a schematic perspective view of the exterior of an electrophotographic printer according to an example.

Figure 2:
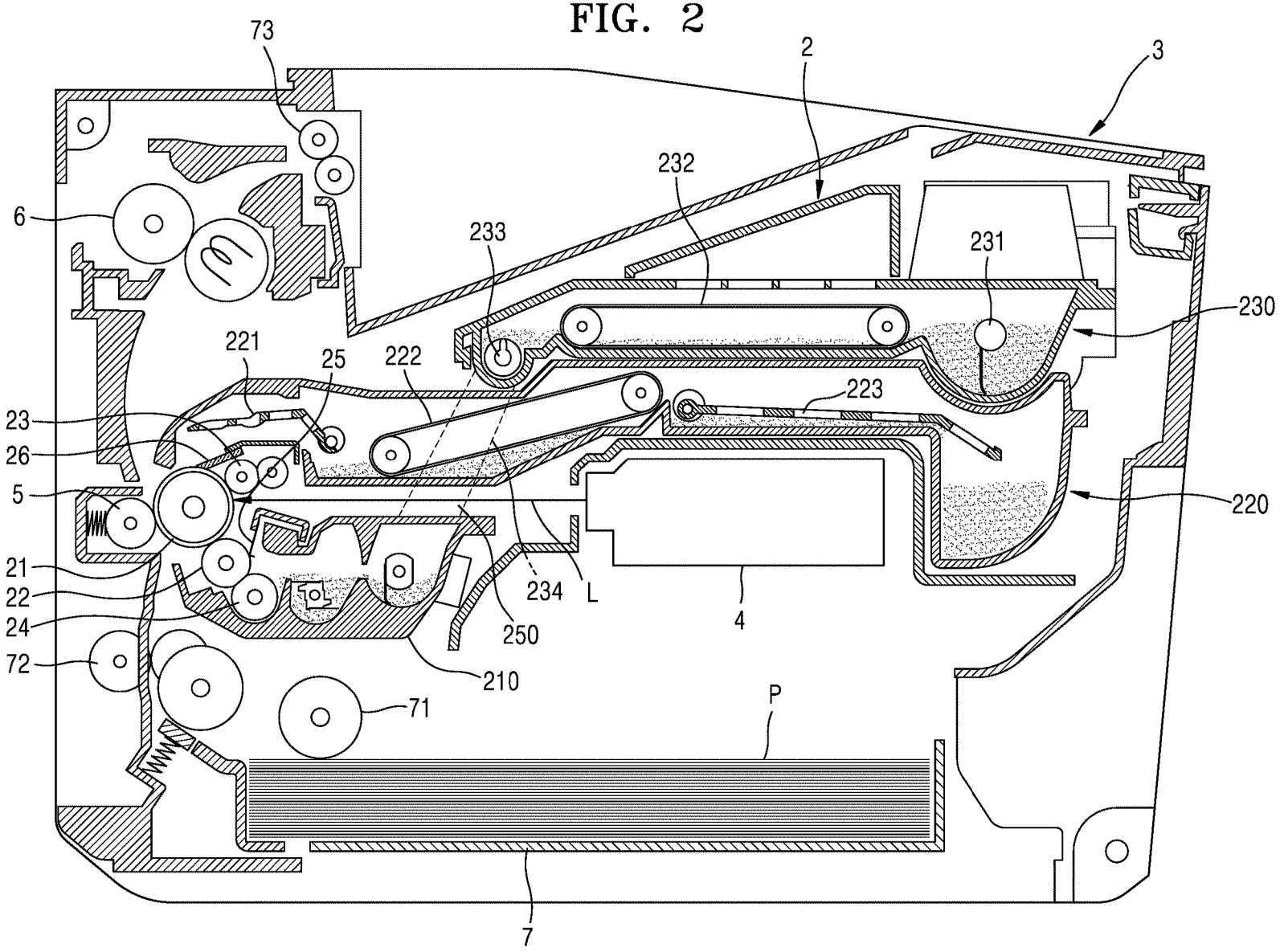
FIG. 2 is a schematic structural diagram of the electrophotographic printer of FIG. 1 according to an example.
Figure 3:
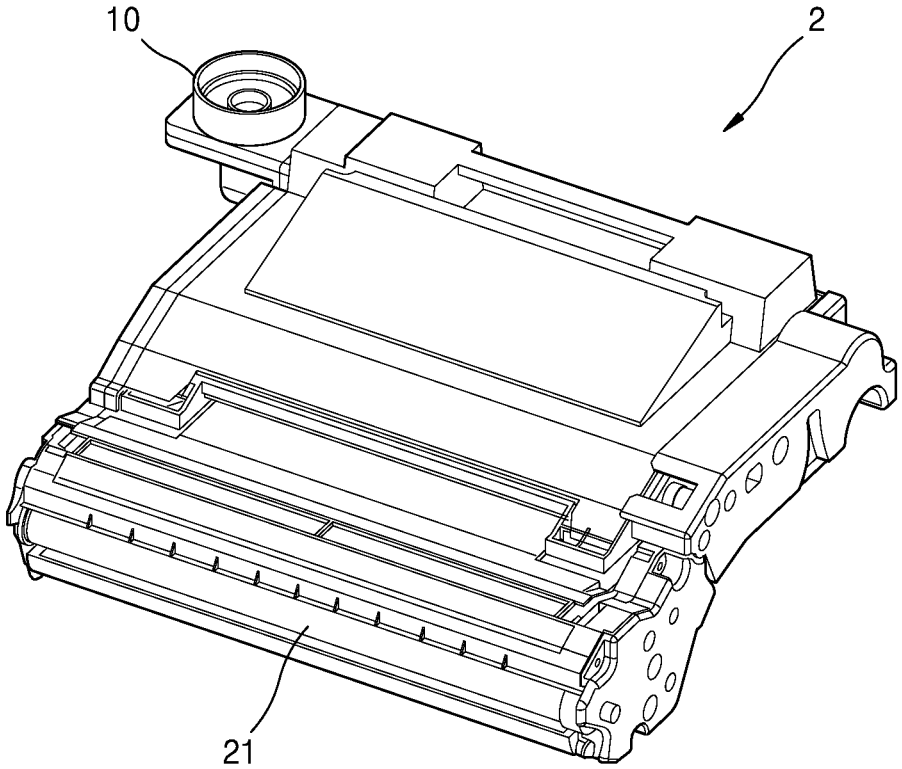
FIG. 3 is a perspective view of a development cartridge included in the electrophotographic printer illustrated in FIG. 1, according to an example.

FIG. 2 is a schematic structural diagram of the electrophotographic printer of FIG. 1 according to an example. FIG. 3 is a perspective view of a development cartridge included in the electrophotographic printer illustrated in FIG. 1, according to an example. Referring to FIGS. 1, 2, and 3, the printer may include a main body 1 and a development cartridge 2 that is attachable to/detachable from the main body 1. A door 3 may be provided in the main body 1. The door 3 opens or closes a portion of the main body 1. While the door 3 opening an upper portion of the main body 1 is illustrated in FIG. 1, a door opening a side portion or a front portion of the main body 1 may be included as needed. The development cartridge 2 may be mounted to or removed from the main body 1 by opening the door 3.

A photosensitive drum 21 is an example of a photoconductor on which an electrostatic latent image is formed, and may include a cylindrical metal pipe and a photoconductive photosensitive layer formed on an outer circumference of the metal pipe. A charging roller 23 is an example of a charger that charges a surface of the photosensitive drum 21 to a uniform electric potential. A charge bias voltage is applied to the charging roller 23. Instead of the charging roller 23, a corona charger (not shown) may be used. A developing roller 22 supplies toner to an electrostatic latent image formed on a surface of the photosensitive drum 21 to develop the electrostatic latent image.

In a two-component developing method in which toner and a carrier are used as a developer, the developing roller 22 may be in the form of a sleeve inside of which a magnet is fixed. The sleeve may be located apart from the photosensitive drum 21 by tens to hundreds of micrometers. The carrier is attached to an outer circumference of the developing roller 22 via a magnetic force of a magnet, and the toner is attached to the carrier via an electrostatic force, thereby forming a magnetic brush including the carrier and the toner on the outer circumference of the developing roller 22. According to a developing bias applied to the developing roller 22, only the toner is moved to the electrostatic latent image formed on the photosensitive drum 21.

In a one-component developing method in which toner is used as a developer, the developing roller 22 may be in contact with the photosensitive drum 21, and may be located apart from the photosensitive drum 21 by tens to hundreds of micrometers. In the present example, a one-component contact developing method in which the developing roller 22 and the photosensitive drum 21 contact each other to form a developing nip is used. The developing roller 22 may be in the form of an elastic layer (not shown) formed on an outer circumference of a conductive metal core (not shown). When a developing bias voltage is applied to the developing roller 22, the toner is moved via the developing nip, to the electrostatic latent image formed on a surface of the photosensitive drum 21 to be attached to the electrostatic latent image.

A supplying roller 24 attaches the toner to the developing roller 22. A supply bias voltage may be applied to the supplying roller 24 to attach the toner to the developing roller 22. Reference numeral 25 denotes a regulating member regulating an amount of toner attached to the surface of the developing roller 22. The regulating member 25 may be, for example, a regulating blade having a front end that contacts the developing roller 22 at a certain pressure. Reference numeral 26 denotes a cleaning member used to remove residual toner and foreign substances from the surface of the photosensitive drum 21 before charging. The cleaning member 26 may be, for example, a cleaning blade having a front end that contacts the surface of the photosensitive drum 21. Hereinafter, foreign substances removed from the surface of the photosensitive drum 21 will be referred to as waste toner.

An optical scanner 4 scans light modulated according to image information, onto a surface of the photosensitive drum 21 charged to a uniform electric potential. As the optical scanner 4, for example, a laser scanning unit (LSU) that scans light radiated from a laser diode onto the photosensitive drum 21 by deflecting the light by using a polygon mirror, in a main scanning direction, may be used.

A transfer roller 5 is an example of a transfer unit that is located to face the photosensitive drum 21 to form a transfer nip. A transfer bias voltage used to transfer a toner image developed on the surface of the photosensitive drum 21 to a print medium P is applied to the transfer roller 5. Instead of the transfer roller 5, a corona transfer unit may be used.

The toner image transferred to a surface of the print medium P via the transfer roller 5 is maintained on the surface of the print medium P due to an electrostatic attractive force. A fusing unit 6 fuses the toner image on the print medium P by applying heat and pressure to the toner image, thereby forming a permanent print image on the print medium P.

Referring to FIGS. 2 and 3, the development cartridge 2 according to the present example includes a developing portion 210 in which the photosensitive drum 21 and the developing roller 22 are mounted, a waste toner container 220 receiving waste toner removed from the photosensitive drum 21, and a toner container 230 connected to the developing portion 210 and containing toner. In order to refill toner in the toner container 230, the development cartridge 2 includes a toner refilling portion 10 connected to the toner container 230. The toner refilling portion 10 provides an interface with respect to the toner cartridge 9 which will be described later and the development cartridge 2. The development cartridge 2 is an integrated type development cartridge including the developing portion 210, the waste toner container 220, the toner container 230, and the toner refilling portion 10.

A portion of an outer circumference of the photosensitive drum 21 is exposed outside a housing. A transfer nip is formed as the transfer roller 5 contacts an exposed portion of the photosensitive drum 21. At least one conveying member conveying toner towards the developing roller 22 may be installed in the developing portion 210. The conveying member may also perform a function of charging toner to a certain electric potential by agitating the toner.

The waste toner container 220 is located above the developing portion 210. The waste toner container 220 is spaced apart from the developing portion 210 in an upward direction to form a light path 250 therebetween. Waste toner removed from the photosensitive drum 21 by using the cleaning member 26 is received in the waste toner container 220. The waste toner removed from the surface of the photosensitive drum 21 is fed into the waste toner container 220 via waste toner feeding member 221, 222, and 223. The shape and number of waste toner feeding members are not limited. An appropriate number of waste toner feeding members may be installed at appropriate locations to effectively distribute waste toner in the waste toner container 220 by considering a volume or shape of the waste toner container 220.

The toner container 230 is connected to the toner refilling portion 10 to receive toner. The toner container 230 is connected to the developing portion 210 via a toner supplier 234 as denoted by a dotted line illustrated in FIG. 2. As illustrated in FIG. 2, the toner supplier 234 may pass through the waste toner container 220 vertically to be connected to the developing portion 210. The toner supplier 234 is located outside an effective width of exposed light L such that the toner supplier 234 does not interfere with the exposed light L scanned in a main scanning direction by using the optical scanner 4.

toner supplying member 231, 232, and 233 used to supply toner to the developing portion 210 through the toner supplier 234 may be installed in the toner container 230. The shape and number of toner supplying members are not limited. An appropriate number of toner supplying members may be installed at appropriate locations to supply toner effectively to the developing portion 210 by considering a volume or shape of the toner container 230. The toner supplying member 233 may convey toner in a main scanning direction to transfer the same to the toner supplier 234.

An image forming process according to the above-described configuration will be described briefly. A charge bias is applied to the charging roller 23, and the photosensitive drum 21 is charged to a uniform electric potential. The optical scanner 4 scans light modulated in accordance with image information, onto the photosensitive drum 21, thereby forming an electrostatic latent image on a surface of the photosensitive drum 21. The supplying roller 24 attaches the toner to a surface of the developing roller 22. The regulating member 25 forms a toner layer having a uniform thickness on the surface of the developing roller 22. A developing bias voltage is applied to the developing roller 22. As the developing roller 22 is rotated, toner conveyed to a developing nip is moved and attached to the electrostatic latent image formed on the surface of the photosensitive drum 21 via the developing bias voltage, thereby forming a visible toner image on the surface of the photosensitive drum 21. The print medium P withdrawn from a loading tray 7 via a pickup roller 71 is fed, via a feeding roller 72, to the transfer nip where the transfer roller 5 and the photosensitive drum 21 face each other. When a transfer bias voltage is applied to the transfer roller 5, the toner image is transferred to the print medium P via an electrostatic attractive force. As the toner image transferred to the print medium P receives heat and pressure from the fusing unit 6, the toner image is fused to the print medium P, thereby completing printing. The print medium P is discharged by using a discharge roller 73. The toner that is not transferred to the print medium P but remains on the surface of the photosensitive drum 21 is removed by using the cleaning member 26.

As described above, the development cartridge 2 supplies the toner contained in the toner container 230 to the electrostatic latent image formed on the photosensitive drum 21 to form a visible toner image, and is attachable to/detachable from the main body 1. In addition, the development cartridge 2 includes the toner refilling portion 10 used to refill toner. The toner refilling portion 10 may be integrated with the development cartridge 2 and thus may be attachable to/detachable from the main body 1 together with the development cartridge 2. According to the printer of the present example, without removing the development cartridge 2 from the main body 1, toner may be refilled in the development cartridge 2 while the development cartridge 2 is mounted in the main body 1.

Figure 4:
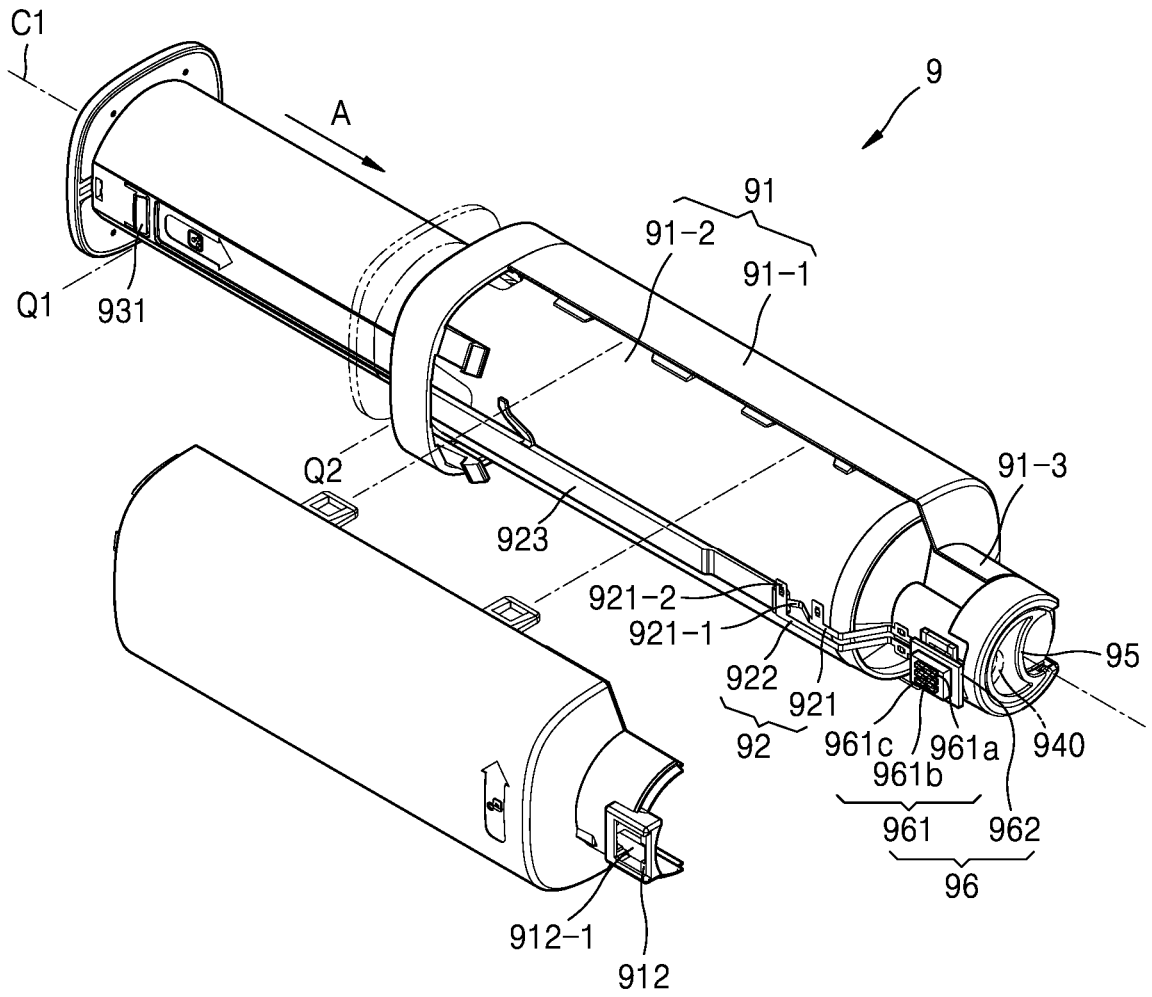
FIG. 4 is a schematic partial perspective view of a toner cartridge according to an example.
Figure 5:
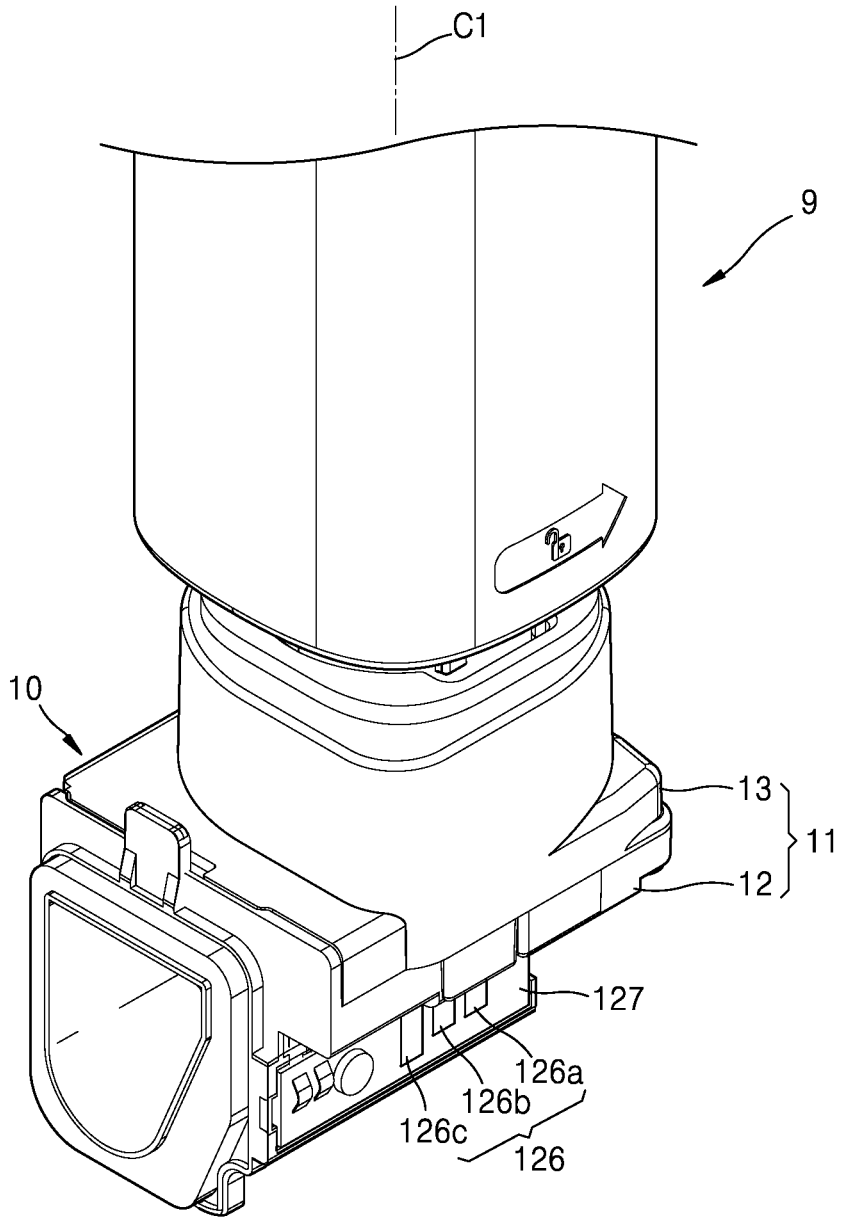
FIG. 5 is a perspective view of a toner refilling portion according to an example.

FIG. 4 is a schematic perspective view of the toner cartridge 9 according to an example. FIG. 5 is a perspective view of the toner refilling portion 10 according to an example. Referring to FIG. 4, the toner cartridge 9 may be a syringe-type toner refill cartridge including a body 91 that contains toner and includes a toner discharging portion 940 and a plunger 93 that is movably coupled to the body 91 in a length direction A to push the toner out of the body 91. The toner discharging portion 940 may be provided at a front end portion 91-3 of the body 91. The discharge shutter 95 selectively opens or closes the toner discharging portion 940. A protruding portion 912 protruding partially and outwardly may be provided at the front end portion 91-3 of the body 91.

The body 91 may include an external body 91-1 and an internal body 91-2 disposed inside the external body 91-1 and containing toner. The toner discharging portion 940 is provided in the internal body 91-2. The plunger 93 may be inserted into the internal body 91-2 to be moved in a length direction A. The plunger 93 may be moved from a top dead position Q1 to a bottom dead position Q2. The discharge shutter 95 is rotatably mounted in the front end portion 91-3 of the body 91 relative to the body 91. For example, as illustrated in FIG. 4, the discharge shutter 95 may be located in a closing position where the toner discharging portion 940 is blocked. The discharge shutter 95 may be rotated about the body 91 by 180 degrees to be in a discharging position where the toner discharging portion 940 is opened. The discharge shutter 95 may be rotated about the first rotational axis C1. The first rotational axis C1 may be, for example, a central axis of the front end portion 91-3 which is cylindrical.

A memory unit 96 may be provided at the front end portion 91-3 of the body 91. As the toner cartridge 9 is mounted in the toner refilling portion 10, the memory unit 96 is electrically connected to the main body 1 to transfer information of the toner cartridge 9 to the main body 1. According to the present example, the memory unit 96 is electrically connected to the main body 1 via a connecting portion provided in the toner refilling portion 10. The main body 1 may determine whether the toner cartridge 9 is mounted based on whether the main body 1 is electrically connected to the memory unit 96, for example, based on whether it is possible for the main body 1 to communicate with the memory unit 96.

The memory unit 96 may include a circuit portion 962 used to monitor or control a state of the toner cartridge 9 and an electrical contact portion 961 used to be connected to the main body 1. A customer replaceable unit monitor (CRUM) portion including a central processing unit (CPU) that performs at least one of authentication and/or encoded data communication with respect to the main body 1 by using an embedded operating system (O/S) may be provided in the circuit portion 962. The circuit portion 962 may further include a memory. The memory may store various types of information about the toner cartridge 9. For example, the memory may store unique information such as manufacturer information, manufacture date information, a serial number, and a model type, various programs, and electronic signature information and information about a usage state (for example, how many sheets have been printed so far, how many more sheets can be printed from a present time, a remaining amount of toner, or the like). In addition, the memory may even store information about a life, a setup menu or the like of the toner cartridge 9. Furthermore, the circuit portion 962 may include a functional block that may be used to perform various functions regarding communication, authentication, encryption, or the like with respect to the main body 1. The circuit portion 962 may be implemented in the form of a chip including a CPU, a chip including a memory and a CPU, or a printed circuit board equipped with a chip and circuit elements used to implement various functional blocks.

The electrical contact portion 961 may have various forms that are electrically connectable to the main body 1, such as a conductive pattern, a modular jack, an elastic terminal or the like. The electrical contact portion 961 according to the present example is a conductive pattern. The electrical contact portion 961 is exposed outside the body 91 through an opening portion 912-1 provided in the protruding portion 912.

For example, the electrical contact portion 961 may include three electrical contacts 961*a*, 961*b*, and 961*c*. The electrical contact 961*a* may be used to transfer information of the circuit portion 962 to the main body 1. The electrical contact 961*b* may be used to transfer a toner refill complete signal to the main body 1. The electrical contact 961*c* may be used to transfer, to the main body 1, a signal indicating whether the toner cartridge 9 is mounted in the toner refilling portion 10.

Referring to FIG. 1, a communicating portion 8 is provided in the main body 1 to provide access to the toner refilling portion 10 from the outside of the main body 1 while the development cartridge 2 is mounted in the main body 1. The communicating portion 8 may be located relatively close to a front portion 1-2 of the main body 1. As the front portion 1-2 faces a user, the user may easily access the communicating portion 8. Accordingly, a toner refilling job via the communicating portion 8 may be performed easily. The communicating portion 8 may be provided in an upper surface 1-1 of the main body 1. The toner refilling portion 10 is located under the communicating portion 8. The communicating portion 8 and the toner refilling portion 10 may be aligned vertically. The toner cartridge 9 may access the toner refilling portion 10 through the communicating portion 8 from above the main body 1.

For example, when the toner cartridge 9 is inserted into the communicating portion 8 from above the main body 1, the toner cartridge 9 may be connected to the toner refilling portion 10 as illustrated in FIG. 5. When pressing the plunger 93 in a length direction A while the toner cartridge 9 is mounted in the toner refilling portion 10, the toner received in the body 91 is discharged through the toner discharging portion 940 to be supplied to the toner container 230 of the development cartridge 2 through the toner refilling portion 10. After toner refilling is completed, the toner cartridge 9 is removed from the communicating portion 8.

According to this configuration, as toner is refilled in the toner container 230 by using the toner refilling portion 10, a replacement time of the development cartridge 2 may be extended until the lifetime of the photosensitive drum 21 ends, thereby reducing printing costs per sheet. In addition, toner may be refilled while the development cartridge 2 is mounted in the main body 1, and thus, user convenience may be increased.

Figure 6:
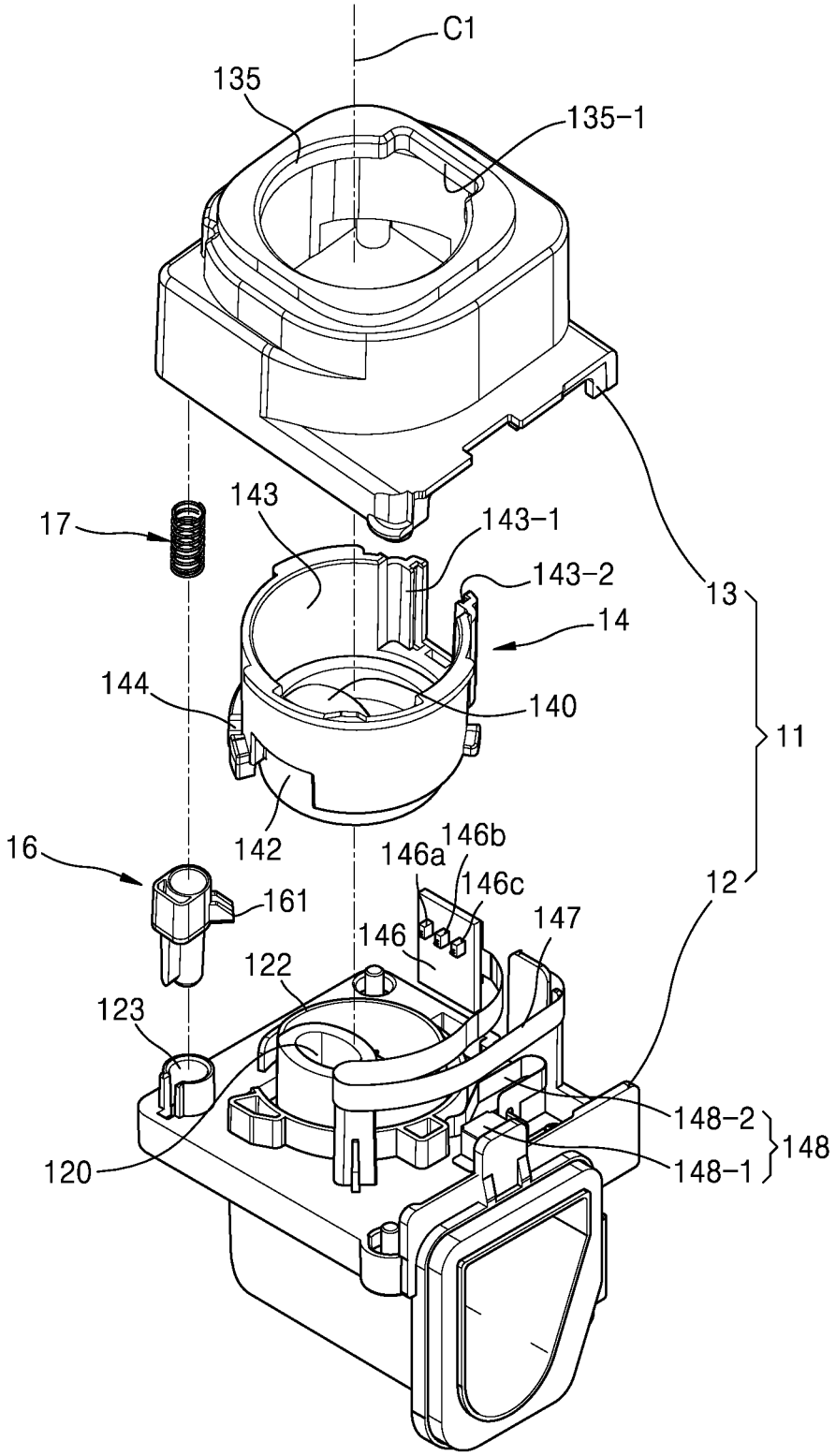
FIG. 6 is an exploded perspective view of a toner refilling portion according to an example.
Figure 7:
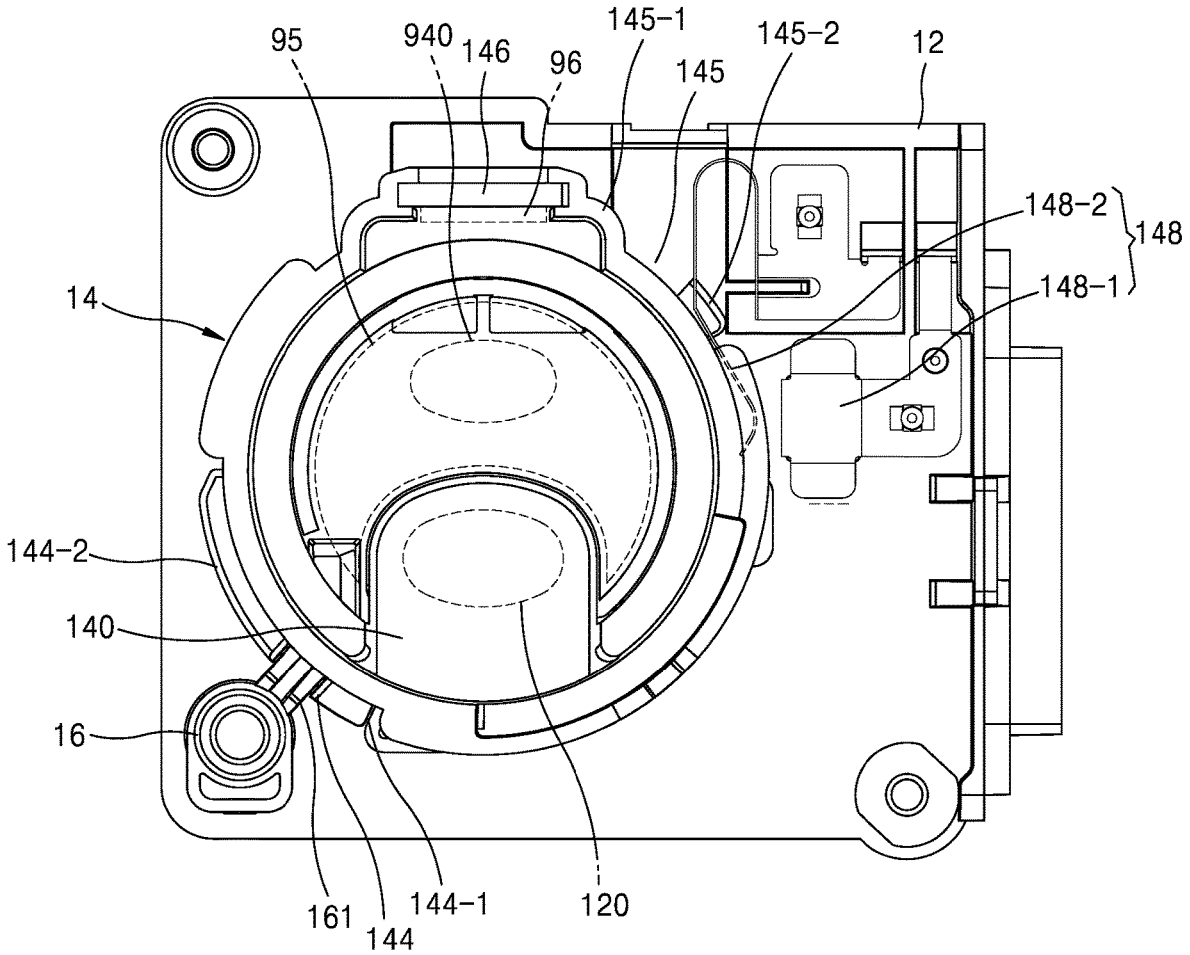
FIG. 7 illustrates an inlet shutter in a blocking position.
Figure 8:
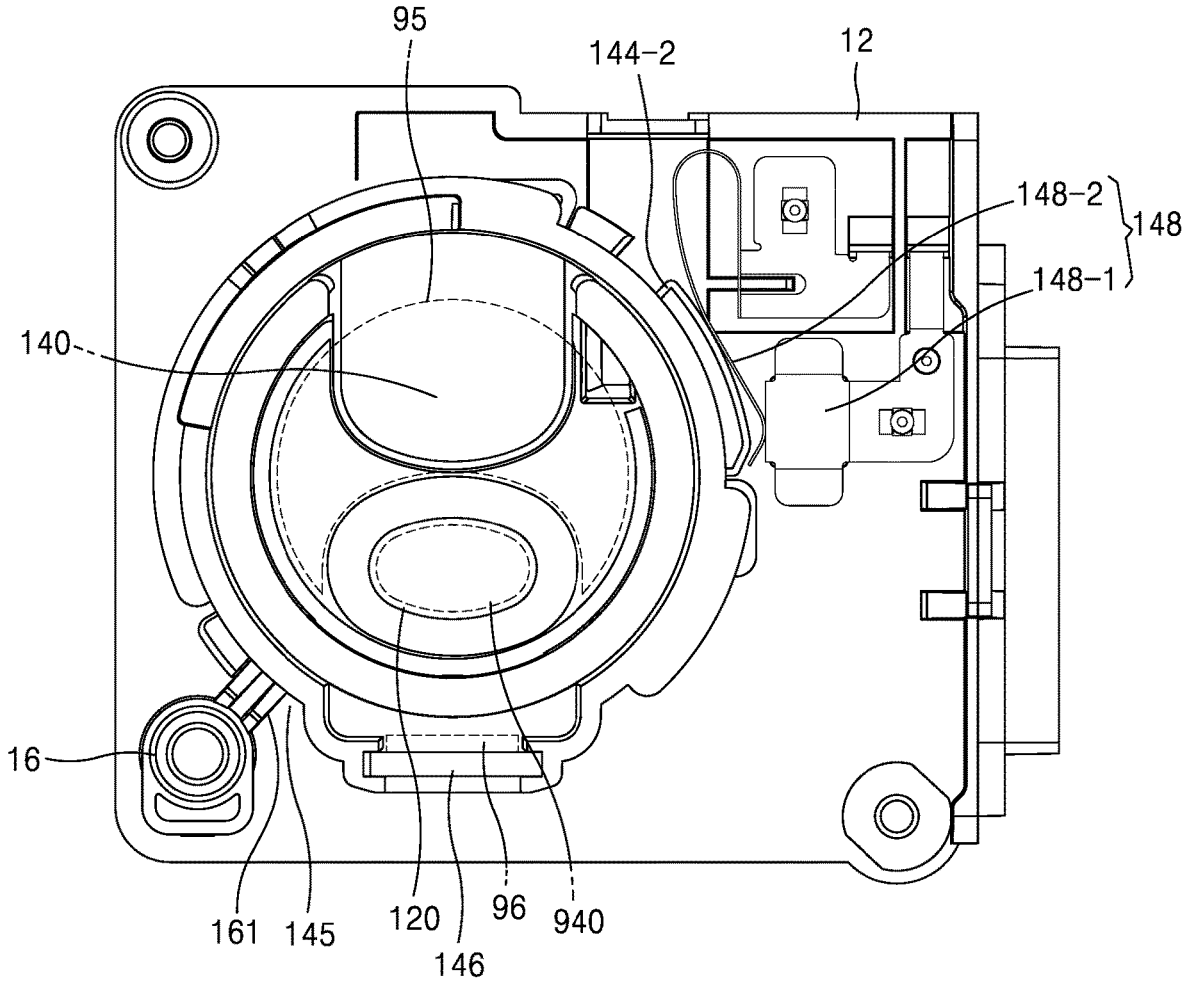
FIG. 8 illustrates an inlet shutter in an inlet position.

FIG. 6 is an exploded perspective view of the toner refilling portion 10 according to an example. FIG. 7 illustrates an inlet shutter 14 in a blocking position. FIG. 8 illustrates the inlet shutter 14 in an inlet position. In FIGS. 7 and 8, an upper body 13 is omitted.

Referring to FIGS. 5 and 6, the toner refilling portion 10 may include a mounting portion 11 in which the toner cartridge 9 is mounted, a toner inlet portion 120, and the inlet shutter 14.

The mounting portion 11 includes the toner inlet portion 120 connected to the toner container 230. The toner cartridge 9 that is inserted through the communicating portion 8 from outside the main body 1 is mounted in the mounting portion 11. The toner inlet portion 120 is provided in the mounting portion 11 to receive toner from the toner cartridge 9. For example, the mounting portion 11 may include a lower body 12 and an upper body 13. The upper body 13 is coupled to the lower body 12. The lower body 12 is connected to the toner container 230. The toner inlet portion 120 is provided in the lower body 12. The mounting portion 11 receives the toner cartridge 9. For example, the mounting portion 11 may receive the front end portion 91-3 of the toner cartridge 9. The mounting portion 11 may rotatably receive the toner cartridge 9.

The inlet shutter 14 is provided in the mounting portion 11 such that it is switchable between the blocking position (FIG. 7) where the toner inlet portion 120 is blocked and the inlet position (FIG. 8) where the toner inlet portion 120 is opened. The inlet shutter 14 may be rotated about the first rotational axis C1 to be switched between the blocking position and the inlet position. For example, the inlet shutter 14 may include a blocking portion 140. The inlet shutter 14 may be provided in the mounting portion 11 such that the inlet shutter 14 is rotatable about the first rotational axis C1 between the blocking position (FIG. 7) where the blocking portion 140 blocks the toner inlet portion 120 and the inlet position (FIG. 8) where the blocking portion 140 is offset from the toner inlet portion 120 to open the toner inlet portion 120.

For example, the inlet shutter 14 may be located between the lower body 12 and the upper body 13. The inlet shutter 14 may be rotatably supported by the lower body 12. A first cylindrical portion 122 that rotatably supports the inlet shutter 14 about the first rotational axis C1 is provided in the lower body 12. The first cylindrical portion 122 may be implemented using, for example, a cylindrical rib arranged with respect to the first rotational axis C1 and protruding toward the upper body 13. The inlet shutter 14 includes a second cylindrical portion 142 surrounding the first cylindrical portion 122 and being rotatably supported by the first cylindrical portion 122. The upper body 13 is coupled to the lower body 12 to cover the inlet shutter 14.

The inlet shutter 14 may be provided in the mounting portion 11 such that the inlet shutter 14 is rotatable with the toner cartridge 9. For example, the inlet shutter 14 includes a receiving portion 143 receiving the front end portion 91-3 of the toner cartridge 9. The inlet shutter 14 has a shape that is rotatable with the toner cartridge 9 when the toner cartridge 9 is rotated about the first rotational axis C1. For example, a shape of the front end portion 91-3 of the toner cartridge 9 may be complementary to a shape of the blocking portion 140. An extension portion 143-1 that is partially opened and protrudes outwardly to receive the protruding portion 912 of the toner cartridge 9 may be formed in the receiving portion 143. An insertion portion 135 and a key groove 135-1 that are respectively aligned with the receiving portion 143 and the extension portion 143-1 may be provided in the upper body 13. The receiving portion 143 and the extension portion 143-1 and the insertion portion 135 and the key groove 135-1 are respectively aligned with each other when the inlet shutter 14 is located in the blocking position.

For example, the toner cartridge 9 may be mounted in the mounting portion 11 by aligning the protruding portion 912 with the key groove 135-1 while the inlet shutter 14 is in the blocking position 11 as illustrated in FIG. 7. Then the front end portion 91-3 of the body 91 is received in the receiving portion 143 of the inlet shutter 14, and the protruding portion 912 is received in the extension portion 143-1, and the front end portion 91-3 of the toner cartridge 9 and the blocking portion 140 are coupled to each other in a complementary manner. The blocking portion 140 covers the toner inlet portion 120. The toner discharging portion 940 of the toner cartridge 9 is in an offset position from the toner inlet portion 120. The toner discharging portion 940 is blocked by the discharge shutter 95 illustrated in FIG. 4.

In this state, when the toner cartridge 9 is rotated about the first rotational axis C1, the inlet shutter 14 is rotated with the toner cartridge 9. Accordingly, the inlet shutter 14 may be rotated between the blocking position and the inlet position. When the toner cartridge 9 is rotated about the first rotational axis C1 such that the inlet shutter 14 deviates from the blocking position, the protruding portion 912 is located in a lower portion of a boundary of the insertion portion 135 of the upper body 13. In this state, even when attempting to separate the toner cartridge 9 from the mounting portion 11, since the protruding portion 912 is caught by the boundary of the insertion portion 135, the toner cartridge 9 is not separated. When the toner cartridge 9 is rotated about the first rotational axis C1 by 180 degrees, as illustrated in FIG. 8, the inlet shutter 14 is in the inlet position, and the blocking portion 140 is offset from the toner inlet portion 120, thereby opening the toner inlet portion 120.

The toner inlet portion 120 and the discharge shutter 95 may have a complementary shape to each other such that the discharge shutter 95 is not rotated but only the body 91 is rotated when the toner cartridge 9 rotates about the first rotational axis C1. Accordingly, when the toner cartridge 9 is rotated about the first rotational axis C1 by 180 degrees, the discharge shutter 95 is caught by an outer portion of the toner inlet portion 120 and is thus not rotated and the body 91 is rotated relative to the discharge shutter 95 by 180 degrees as illustrated in FIG. 8. The toner discharging portion 940 of the toner cartridge 9 is opened, and the toner discharging portion 940 is aligned with the toner inlet portion 120. By pressing the plunger 93 in this state, toner may be supplied from the body 91 to the toner container 230 through the toner discharging portion 940 and the toner inlet portion 120.

Electrical connection between the toner cartridge 9 and the toner refilling portion 10 will now be described. As described above, the memory unit 96 of the toner cartridge 9 is electrically connected to the main body 1 via a connecting portion provided in the toner refilling portion 10, for example, to a controller 300 provided in the main body 1. Referring to FIGS. 5 and 6, the connecting portion may include a first connecting portion 146 and a second connecting portion 127. The first connecting portion 146 is connected to the electrical contact portion 961 of the toner cartridge 9 when the toner cartridge 9 is mounted in the mounting portion 11. The second connecting portion 127 is connected to the first connecting portion 146 via a flexible cable 147. The second connecting portion 127 is electrically connected to the controller 300 (FIG. 12) which will be described later.

A mounting groove 143-2 in which the first connecting portion 146 electrically connected to the memory unit 96 of the toner cartridge 9 is mounted may be provided in the extension portion 143-1 of the inlet shutter 14. The first connecting portion 146 may be electrically connected to the electrical contact portion 961 of the toner cartridge 9. For example, three electrical contacts 146*a*, 146*b*, and 146*c* respectively corresponding to the three electrical contacts 961*a*, 961*b*, and 961*c* may be provided in the first connecting portion 146. The three electrical contacts 146*a*, 146*b*, and 146*c* may be electrically connected to the second connecting portion 127 provided in the mounting portion 11, for example, in the lower body 12, via the flexible cable 147. Accordingly, while the inlet shutter 14 rotates between a blocking position and an inlet position, a stable electrical connection between the first connecting portion 146 and the second connecting portion 127 may be maintained. An electrical contact portion 126 may be provided in the second connecting portion 127. The electrical contact portion 126 may be electrically connected to the electrical contact portion 961 of the toner cartridge 9 when the toner cartridge 9 is mounted in the mounting portion 11.

The development cartridge 2 according to the present example is an integration-type development cartridge 2 in which the toner refilling portion 10 is integrated, as illustrated in FIG. 3. The development cartridge 2 may be distributed while being mounted in the main body 1. The development cartridge 2 is a consumable item that is replaced when the life of the development cartridge 2 ends, and may be distributed separately from the main body 1. When the toner inlet portion 120 is opened in a distribution stage, toner contained in the toner container 230 may be leaked out. The leaked toner may contaminate the toner refilling portion 10. When the toner inlet portion 120 is opened during the distribution stage where the development cartridge 2 is distributed while being mounted in the main body 1, the inside of the main body 1 may be contaminated by the leaked toner.

Figure 9:
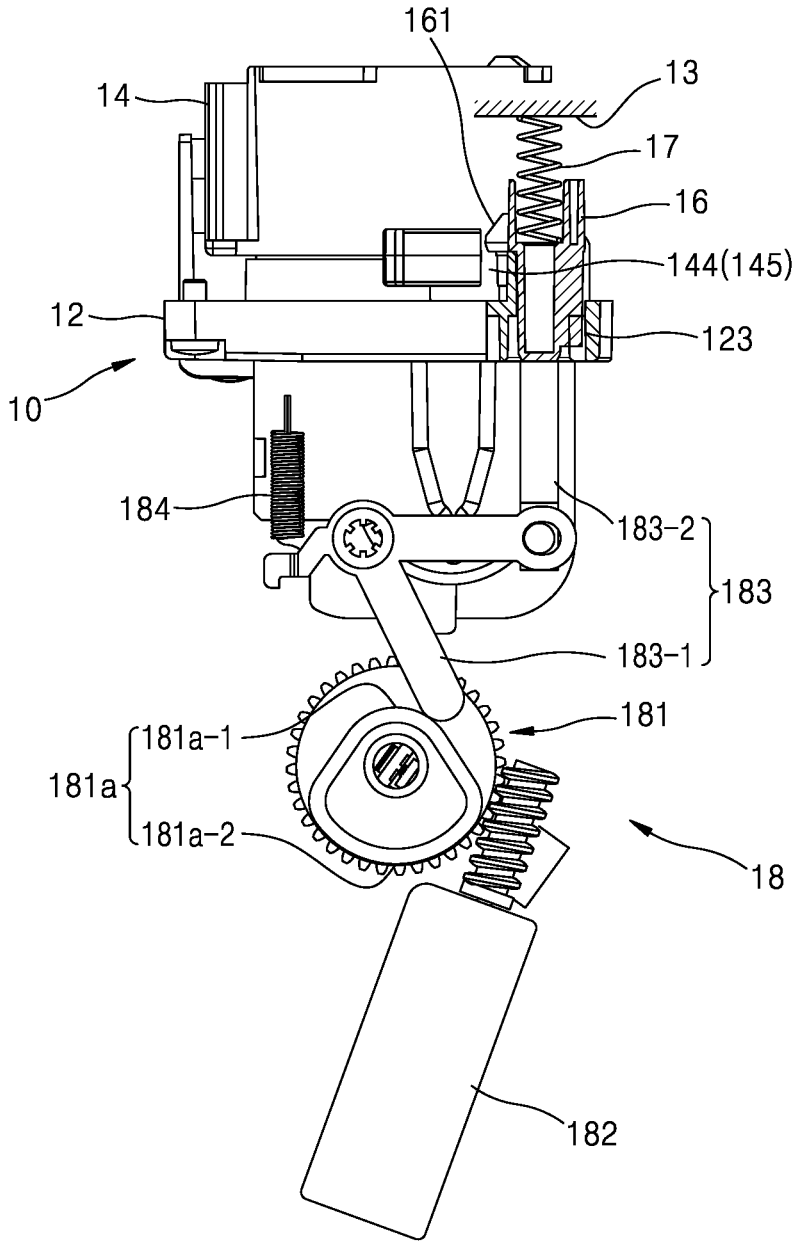
FIG. 9 is a schematic structural diagram of a switching member according to an example, in which a latch member is in a first position.
Figure 10:
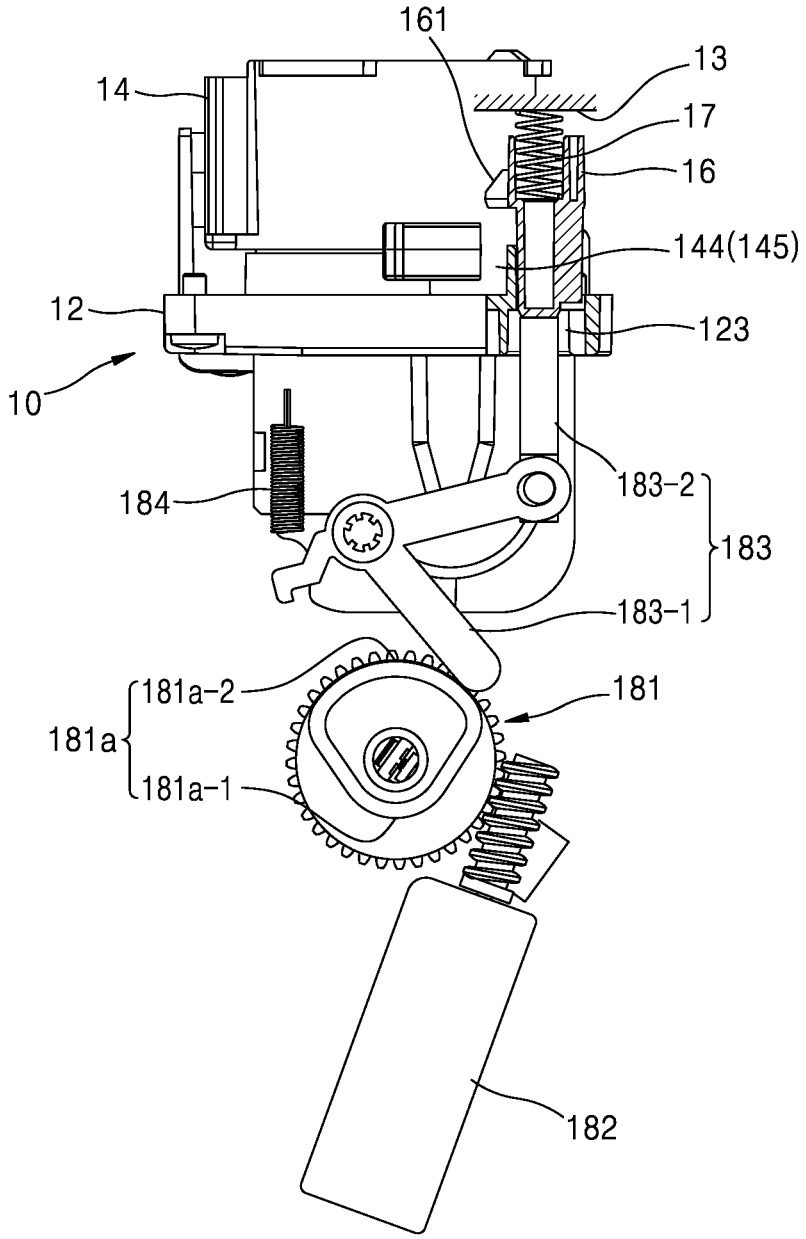
FIG. 10 is a schematic structural diagram of a switching unit according to an example, in which the latch member is in a second position.
Figure 11:
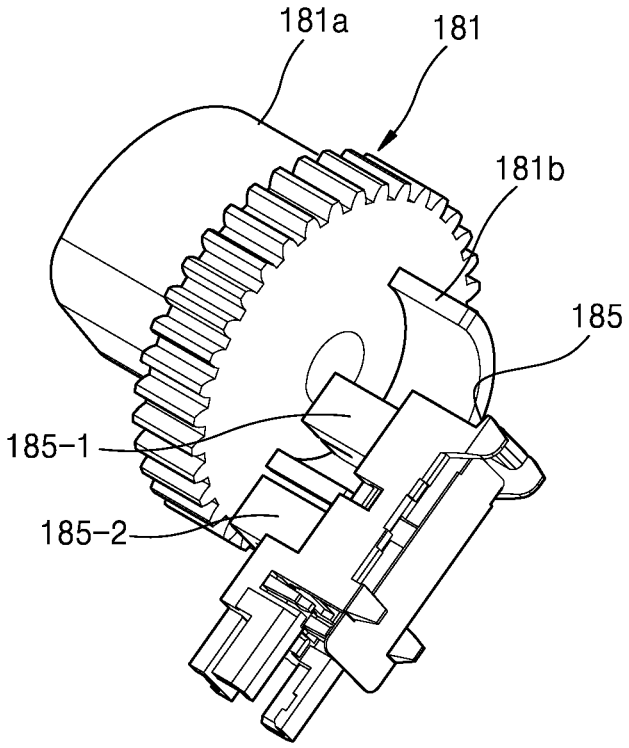
FIG. 11 illustrates a structure of detecting a phase of a rotational cam according to an example.

Considering this, the printer according to the present example includes a locking unit that selectively locks the inlet shutter 14. The locking unit includes an electrical actuator. By driving the electrical actuator by using the controller 300 (FIG. 12) which will be described later, the locking unit may be controlled to selectively lock the inlet shutter 14. FIG. 9 is a schematic structural diagram of the locking unit according to an example, showing the inlet shutter 14 in a locked state. FIG. 10 is a schematic structural diagram of the locking unit according to an example, showing the inlet shutter 14 in an unlocked state. FIG. 11 illustrates a structure of detecting a phase of a rotational cam 181 according to an example. In FIGS. 9 and 10, the upper body 13 is omitted.

Referring to FIGS. 6 through 11, the locking unit may include a latch member 16 having a first position where the inlet shutter 14 is locked and a second position where rotation of the inlet shutter 14 is allowed and a switching member 18 selectively switching the latch member 16 between the first position and the second position. In the present example, the latch member 16 is provided in the toner refilling portion 10, and the switching member 18 is provided in the main body 1.

Referring to FIGS. 6, 7 and 8, the latch member 16 may be provided in the mounting portion 11 such that the latch member 16 is switchable between the first position and the second position. The latch member 16 may be moved in a direction of the first rotational axis C1 to be switched between the first position and the second position. For example, referring to FIG. 6, an operation hole 123 extending in a direction of the first rotational axis C1 may be formed in the lower body 12. The latch member 16 may be movably inserted into the operation hole 123 in the direction of the first rotational axis C1. A latch spring 17 applies an elastic force to the latch member 16 in a direction in which the latch member 16 is located in the first position. The latch spring 17 may be in various forms such as a coil spring, a leaf spring, or a resilient arm integrally formed with the latch member 16. In the present example, the latch spring 17 may be implemented by a compression coil spring having a first end portion supported by the upper body 13 and a second end portion supported by the latch member 16.

The latch member 16 may lock the inlet shutter 14 in the blocking position. A first latching portion 144 is provided in the inlet shutter 14. The first latching portion 144 may be implemented, for example, by a protrusion 144-1 and a contact protrusion 144-2 that protrude outwardly from an outer circumference of the inlet shutter 14 and are spaced apart from each other in a circumferential direction. The latch member 16 may include a latching protrusion 161 which is caught by the first latching portion 144 when the latch member 16 is located in the first position. Referring to FIG. 7, when the inlet shutter 14 is located in the blocking position, the latching protrusion 161 of the latch member 16 located in the first position is caught by the first latching portion 144, and the inlet shutter 14 is locked in the blocking position. The latch member 16 may be held in the first position via the latch spring 17 when the development cartridge 2 is separated from the main body 1. Thus, during distribution of the development cartridge 2 while the development cartridge 2 is mounted in the main body 1 or is apart from the main body 1, the toner inlet portion 120 may be maintained in a closed state, and accordingly, toner leakage may be prevented.

When the toner cartridge 9 is mounted in the mounting portion 11 and is rotated during refilling of toner, the inlet shutter 14 is also rotated so that the toner inlet portion 120 and the toner discharging portion 940 may be offset from each other. Then, the toner discharged through the toner discharging portion 940 may leak out of the toner inlet portion 120 to contaminate the toner refilling portion 10.

Considering this, the latch member 16 may lock the inlet shutter 14 in the inlet position. Referring to FIGS. 7 and 8, a second latching portion 145 is provided on the inlet shutter 14. The second latching portion 145 may be implemented using a pair of protrusions 145-1 and 145-2 that protrude outwardly from the outer circumference of the inlet shutter 14 and are spaced apart from each other in a circumferential direction. As illustrated in FIG. 8, when the inlet shutter 14 is located in the inlet position, the latching protrusion 161 of the latch member 16 located in the first position is caught by the second latching portion 145, and the inlet shutter 14 is locked in the inlet position. Accordingly, while the toner cartridge 9 is mounted in the mounting portion 11 and toner is being refilled, the inlet shutter 14 is not rotated, and the toner may be stably refilled in the toner container 230 without toner leakage.

The switching member 18 selectively switches the latch member 16 between the first position and the second position. The switching member 18 may be implemented in various forms. Referring to FIGS. 9 and 10, the switching member 18 according to the present example is an example of an electrical actuator, and includes an electric motor 182. The switching member 18 may include a rotational cam 181 including a cam track 181*a*, the electric motor 182 rotating the rotational cam 181, and a moving member 183 guided to the cam track 181*a* to switch the latch member 16 between the first and second positions. The cam track 181*a* may include first and second cam portions 181*a*-1 and 181*a*-2 respectively corresponding to the first and second positions of the latch member 16. The moving member 183 may include a first moving member 183-1 guided to the cam track 181*a* to be pivoted and a second moving member 183-2 connected to the first moving member 183-1 to be lifted. When the development cartridge 2 is mounted in the main body 1, the second moving member 183-2 may be inserted into the operation hole 123, in which the latch member 16 is installed, to thereby contact the latch member 16. The cam spring 184 applies an elastic force to the moving member 183 in a direction in which the moving member 183 contacts the cam track 181*a*. According to the present example, the cam spring 184 is implemented by using a tensile coil spring having a first end portion connected to the first moving member 183-1 and a second end portion supported by the main body 1. The first end portion of the first moving member 183-1 is maintained in a contact state with the cam track 181*a* via the cam spring 184. The electric motor 182 may be, for example, a direct current (DC) motor. For example, a worm gear may be mounted on a rotational axis of the electric motor 182. A worm wheel to which the worm gear engages may be provided to the rotational cam 181. When the electric motor 182 rotates, the rotational cam 181 may be rotated.

Figure 12:
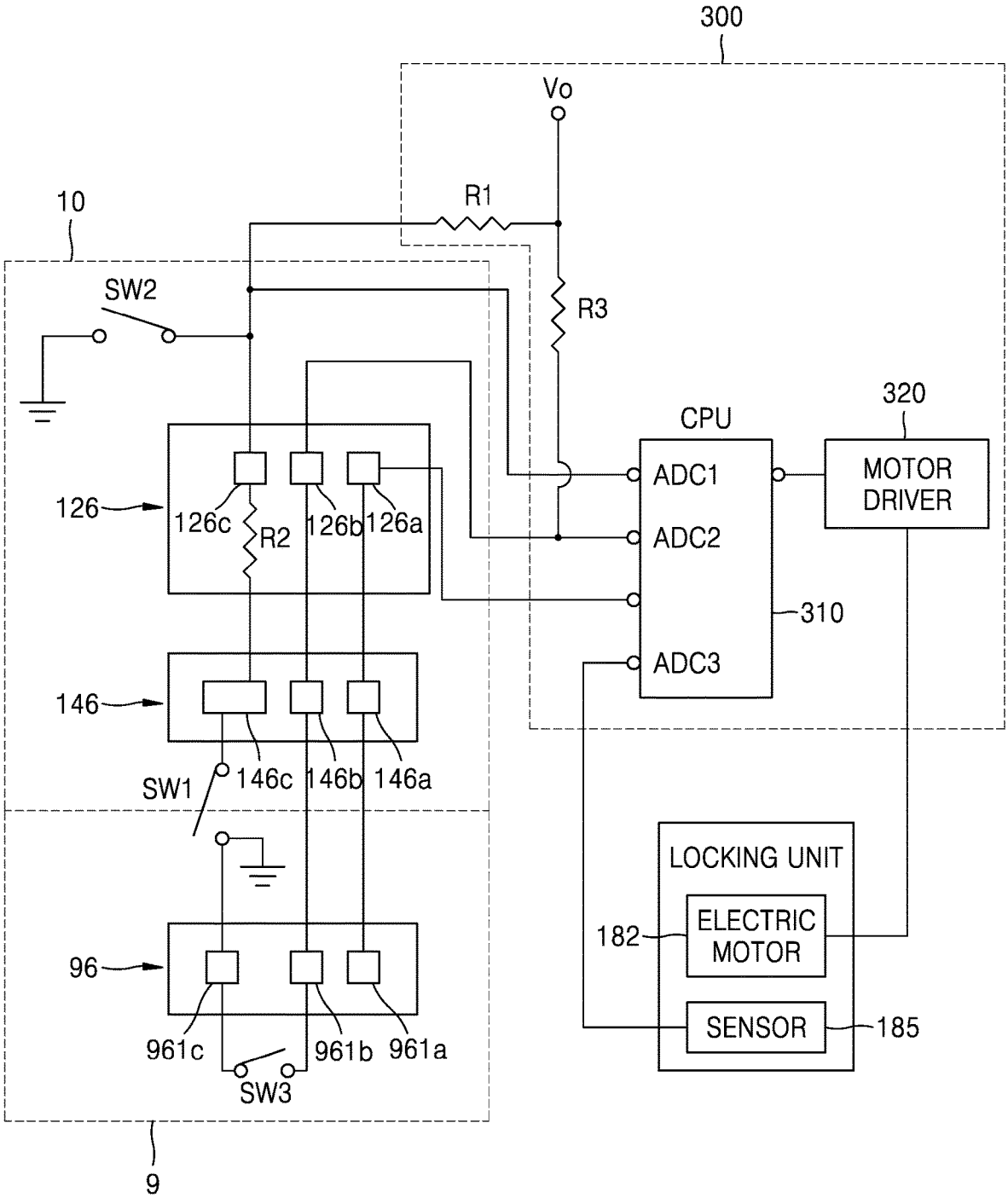
FIG. 12 is a control block diagram for selectively locking an inlet shutter according to an example.

Referring to FIG. 11, the switching member 18 may further include a sensor 185 detecting a phase of the rotational cam 181. For example, the sensor 185 may be implemented using a photo-interrupter including a light emitting portion 185-1 and a light receiving portion 185-2. A light shielding rib 181*b* blocking light between the light emitting portion 185-1 and the light receiving portion 185-2 according to a rotational phase may be provided on the rotational cam 181. For example, when light is blocked via the light shielding rib 181*b* and thus no light is detected from the light receiving portion 185-2, the light receiving portion 185-2 may generate an ON detection signal; when light is detected from the light receiving portion 185-2, the light receiving portion 185-2 may generate an OFF detection signal. A detection signal of the sensor 185 may be input to an input port ADC3 of the controller 300 (FIG. 12). For example, when an angle between two ends of the light shielding rib 181*b* is 180 degrees, in a moment when a detection signal of the light receiving portion 185-2 changes from ON to OFF, the moving member 183 may be guided to the first cam portion 181*a*-1 of the rotational cam 181, and in a moment when a detection signal of the light receiving portion 185-2 changes from OFF to ON, the moving member 183 may be guided to the second cam portion 181*a*-2 of the rotational cam 181. According to this configuration, a rotational phase of the rotational cam 181 may be detected, and the latch member 16 may be positioned in the first position or the second position.

The electric motor 182 is driven in an initial state and stopped in a moment when a detection signal of the light receiving portion 185-2 changes from ON to OFF. Then the moving member 183 is guided to the first cam portion 181*a*-1, and the moving member 183 moves away from the latch member 16, and accordingly, due to an elastic force of the latch spring 17, the latch member 16 is located in the first position as illustrated in FIG. 9. As the latching protrusion 161 of the latch member 16 is caught by the first latching portion 144 or the second latching portion 145 of the inlet shutter 14, the inlet shutter 14 is locked in the blocking position or the inlet position.

To allow rotation of the inlet shutter 14, the electric motor 182 is driven and then stopped in a moment when a detection signal of the light receiving portion 185-2 changes from OFF to ON. Then the moving member 183 is guided to the second cam portion 181*a*-2, and the moving member 183 pushes the latch member 16 in an opposite direction to the elastic force of the latch spring 17. Then, as illustrated in FIG. 10, the latch member 16 is located in the second position. As the latching protrusion 161 of the latch member 16 deviates upwards from the first latching portion 144 or second latching portion 145 of the inlet shutter 14, the inlet shutter 14 may be rotated from the blocking position to the inlet shutter 14 or in an opposite direction thereto.

FIG. 12 is a control block diagram for selectively locking the inlet shutter 14 according to an example. Referring to FIG. 12, the printer includes the controller 300. The controller 300 is provided in a main body 1. The controller 300 may be implemented using various electric components and electric circuits used to control an image forming process. Referring to FIG. 12, a structure of the controller 300 used to control a locking unit in connection with mounting and rotation of the toner cartridge 9 is briefly illustrated. The controller 300 may include a CPU 310 and a motor driver 320 driving the electric motor 182 of the locking unit.

The controller 300 may control the locking unit such that the locking unit selectively locks or unlocks the inlet shutter 14 based on whether the toner cartridge 9 is mounted in the toner refilling portion 10. In addition, the controller 300 may control the locking unit such that the locking unit selectively locks or unlocks the inlet shutter 14 based on a rotational phase of the toner cartridge 9, that is, a position of the inlet shutter 14. The controller 300 is connected to the toner cartridge 9 via the electrical contact portion 126 provided in the mounting portion 11. The controller 300 may control the locking unit such that the locking unit selectively locks or unlocks the inlet shutter 14 based on an electrical signal input via the electrical contact portion 126.

The printer includes an electrical structure used to detect whether the toner cartridge 9 is mounted in the mounting portion 11. The electrical structure may include an electrical contact 126*c* (second electrical contact for detecting mounting) that is electrically connected to the electrical contact 961*c* (first electrical contact for detecting mounting) provided in the toner cartridge 9 when the toner cartridge 9 is mounted in the mounting portion 11. The electrical contact 126*c* is connected to the controller 300. The controller 300 may detect whether the toner cartridge 9 is mounted in the mounting portion 11 by detecting whether the electrical contact 961*c* and the electrical contact 126*c* are electrically connected. The controller 300 may control the locking unit such that the locking unit locks or unlocks the inlet shutter 14 based on whether the toner cartridge 9 is mounted in the mounting portion 11.

When the toner cartridge 9 is mounted in the mounting portion 11, the electrical contact 961*c* is electrically connected to the electrical contact 126*c* via the electrical contact 146*c*. Accordingly, it may be regarded that there is a first switch SW1 between the electrical contact 961*c* and the electrical contact 126*c* in FIG. 12. When the toner cartridge 9 is not mounted in the mounting portion 11, it may be regarded that the first switch SW1 is opened; when the toner cartridge 9 is mounted in the mounting portion 11, it may be regarded that the first switch SW1 is closed. The first switch SW1 may be electrically connected to the controller 300 via the electrical contact 126*c*.

Various structures may be used to detect whether the first switch SW1 is opened or closed. For example, whether the first switch SW1 is opened or closed may be detected via an electric circuit including a reference voltage Vo and two resistors R1 and R2 connected in parallel to each other. While the first switch SW1 is opened, no current flows through the electric circuit passing through the electrical contact 126*c*. The reference voltage Vo, for example, 3.3 V, is applied to an input port ADC1 of the controller 300 connected to the electrical contact 126*c* without any change. When the first switch SW1 is closed, the electric circuit passing through the electrical contact 126*c* becomes an electric circuit in which the resistor R1 and the resistor R2 are connected in parallel to each other. For example, when resistance values of the resistor R1 and the resistor R2 are equal, a voltage of, for example, 1.65 V, is applied to the input port ADC1 of the controller 300. Whether the first switch SW1 is opened or closed may be detected based on a variation in the voltage applied to the input port ADC1. The controller 300 may detect whether the toner cartridge 9 is mounted in the mounting portion 11 based on a variation in a voltage applied to the input port ADC1, and may control the locking unit to selectively lock the inlet shutter 14 based on a detection result.

From another perspective, it may be regarded that the resistor R2 functions as a detection resistor used to detect whether the toner cartridge 9 is mounted. Whether the resistor R2 is detected or not from the electrical circuit including the electrical contact 126*c* may be determined based on whether the toner cartridge 9 is mounted in the mounting portion 11. That is, the resistor R2 is not detected while the first switch SW1 is opened, and the resistor R2 may be detected while the first switch SW1 is closed.

Referring back to FIG. 6, a rotation detection sensor 148 detecting rotation of the toner cartridge 9, for example, 180-degree rotation thereof, may be provided in the toner refilling portion 10. As the inlet shutter 14 is rotated together with the toner cartridge 9, the rotation detection sensor 148 may detect whether the inlet shutter 14 has reached the inlet position. For example, the rotation detection sensor 148 may include a pair of electrodes 148-1 and 148-2 that are provided in the mounting portion 11, for example, in the lower body 12, and that have an electrical connection state changing when the inlet shutter 14 reaches the inlet position. The electrode 148-1 may be a fixed electrode, and the electrode 148-2 may be a spring electrode that elastically contacts or is separated from the fixed electrode. The pair of electrodes 148-1 and 148-2 may be connected to the controller 300 via the electrical contact 126*c* provided in the second connecting portion 127. An electrical contact state of the pair of electrodes 148-1 and 148-2 may be changed from a first state to a second state when the inlet shutter 14 reaches the inlet position. The first state and the second state may be respectively an electrically open state and an electrical short state or vice versa.

For example, referring to FIGS. 7 and 8, the contact protrusion 144-2 that interferes with the electrode 148-2 to bring the pair of electrodes 148-1 and 148-2 into contact with each other, when the inlet shutter 14 has reached the inlet position may be provided in the inlet shutter 14. Referring to FIG. 7, the inlet shutter 14 is located in the blocking position, and the contact protrusion 144-2 is spaced apart from the pair of electrodes 148-1 and 148-2. The pair of electrodes 148-1 and 148-2 are spaced apart from each other and are thus in an electrically open state. When the toner cartridge 9 is rotated by, for example, 180 degrees, the inlet shutter 14 is also rotated by 180 degrees to be in the inlet position. Then, as illustrated in FIG. 8, the contact protrusion 144-2 pushes the electrode 148-1 to bring the pair of electrodes 148-1 and 148-2 into contact with each other. When the inlet shutter 14 returns to the blocking position, as illustrated in FIG. 7, the contact protrusion 144-2 is spaced apart from the pair of electrodes 148-1 and 148-2, and the electrode 148-1 elastically returns to its original position so that the pair of electrodes 148-1 and 148-2 are spaced apart from each other. An electrical contact state of the pair of electrodes 148-1 and 148-2 may be transferred to the controller 300 via the electrical contact 126*c*. The controller 300 may control the locking unit such that the locking unit locks or unlocks the inlet shutter 14 based on a detection signal that is received via the electrical contact 126*c*.

An electrical connection state of the pair of electrodes 148-1 and 148-2 may be detected by using various structures. For example, in FIG. 12, the pair of electrodes 148-1 and 148-2 may be regarded as a second switch SW2. When the toner cartridge 9 is mounted in the mounting portion 11, the first switch SW1 is closed. When the inlet shutter 14 is located in the blocking position, the second switch SW2 is opened. For example, when resistance values of the resistors R1 and R2 are equal, a voltage of, for example, 1.65 V, is applied to the input port ADC1 of the controller 300. When the toner cartridge 9 is rotated by, for example, 180 degrees, such that the inlet shutter 14 reaches the inlet position, the second switch SW2 is closed. Then, as a current flows through an electrical circuit including the second switch SW2, a voltage of 0 V is applied to the input port ADC1 of the controller 300. Accordingly, the controller 300 may detect whether the inlet shutter 14 has reached the inlet position based on a variation in a voltage applied to the input port ADC1, and may control the locking unit to selectively lock the inlet shutter 14 based on a detection result.

A toner filling completion detection sensor 92 detecting whether toner filling is completed may be provided in the toner cartridge 9. For example, referring to FIG. 4, the toner filling completion detection sensor 92 may include a pair of electrodes 921 and 922 provided between the external body 91-1 and the internal body 91-2. The pair of electrodes 921 and 922 may be respectively connected to the electrical contacts 961*b* and 961*c*. An electrical contact state of the pair of electrodes 921 and 922 may be varied according to a position of the plunger 93. An electrical contact state of the pair of electrodes 921 and 922 may be changed from a first state to a second state when the plunger 93 reaches the bottom dead position Q2. For example, the first state and the second state may be respectively an electrically open state and an electrical short state or vice versa. For example, first ends 921-1 and 921-2 of the pair of electrodes 921 and 922 are spaced apart from each other. As the plunger 93 is moved in the length direction A to reach the bottom dead position Q2, the first ends 921-1 and 921-2 of the pair of electrodes 921 and 922 may contact each other. For example, an operating lever 923 that is movable in the length direction A may be provided between the external body 91-1 and the internal body 91-2. A pushing protrusion 931 that pushes the operating lever 923 when the plunger 93 has reached the bottom dead position Q2 to thereby bring the first ends 921-1 and 921-2 of the pair of electrodes 921 and 922 into contact with each other may be provided in the plunger 93.

An electrical contact state of the pair of electrodes 921 and 922 may be transferred to the controller 300 via the electrical contact 961*b* and the electrical contact 146*b* and through the electrical contact 126*b* (electrical contact for detecting toner filling completion).

An electrical connection state of the pair of electrodes 921 and 922 may be detected by using various structures. For example, in FIG. 12, the pair of electrodes 921 and 922 may be regarded as a third switch SW3. Before the plunger 93 reaches the bottom dead position Q2, the third switch SW3 is in an open state. Accordingly, no current flows through a circuit that includes the electrical contact 126*b*, and a voltage Vo, for example, 3.3 V, is applied to the input port ADC2 of the controller 300 without any change. When the plunger 93 reaches the bottom dead position Q2, the third switch SW3 is in a closed state, and a current flows through the circuit including the electrical contact 126*b*. Then a voltage drop occurs due to the resistor R3, and a voltage of 0 V is applied to the input port ADC2 of the controller 300. Thus, the controller 300 may detect whether toner filling is completed based on a variation in a voltage applied to the input port ADC2, and may control the locking unit to selectively lock the inlet shutter 14 based on a detection result.

A method of controlling toner refilling according to an example based on the above-described configuration will be described.

Before the toner cartridge 9 is mounted in the mounting portion 11, the inlet shutter 14 is located in the blocking position as illustrated in FIG. 7. The first switch SW1 and the second switch SW2 are both in an open state. A signal of, for example, 3.3 V (first voltage signal), is input to the input port ADC1 of the controller 300.

The controller 300 controls the locking unit such that the latch member 16 is caught by the first latching portion 144 to lock the inlet shutter 14 in the blocking position. For example, the controller 300 drives the electric motor 182 based on a detection signal received from the sensor 185 such that the first cam portion 181*a*-1 of the rotational cam 181 faces the moving member 183. Then, as illustrated in FIG. 9, the latch member 16 is maintained in the first position where the latching protrusion 161 is caught by the first latching portion 144 via an elastic force of the latch spring 17, thereby locking the inlet shutter 14 in the blocking position.

When the toner cartridge 9 is mounted in the mounting portion 11, the first switch SW1 is closed. The second switch SW2 and the third switch SW3 are in an open state. A signal of, for example, 1.65 V (second voltage signal) is input to the input port ADC1 of the controller 300, and accordingly, electrical connection between the electrical contact 961*c* and the electrical contact 146*c* is detected from the controller 300. A signal of, for example, 3.3 V (fourth voltage signal) is input to the input port ADC2 of the controller 300. The memory unit 96 of the toner cartridge 9 is connected to a data input port of the controller 300 via the electrical contact 961*a*, the electrical contact 146*a*, and the electrical contact 126*a*. The controller 300 may read from the circuit portion 962 information about the toner cartridge 9. The controller 300 controls the locking unit to unlock the inlet shutter 14 such that the inlet shutter 14 and the toner cartridge 9 are rotated together. For example, the controller 300 drives the electric motor 182, based on a detection signal input from the sensor 185, such that the second cam portion 181*a*-2 of the rotational cam 181 faces the moving member 183. Then, as illustrated in FIG. 10, the latch member 16 is moved in an opposite direction to an elastic force of the latch spring 17 via the moving member 183 so that the latching protrusion 161 deviates from the first latching portion 144 to be in the second position where rotation of the inlet shutter 14 is allowed.

Next, the toner cartridge 9 is rotated by a user in a first direction, for example, by 180 degrees. Then, the inlet shutter 14 is in the inlet position as illustrated in FIG. 8. The first switch SW1 is maintained in a closed state. The toner inlet portion 120 and the toner discharging portion 940 of the toner cartridge 9 are both opened and aligned with each other. Whether the inlet shutter 14 has reached the inlet position is detected by using the rotation detection sensor 148. The contact protrusion 144-2 of the inlet shutter 14 pushes the electrode 148-1 to bring the pair of electrodes 148-1 and 148-2 into contact with each other. The second switch SW2 is in a closed state. The third switch SW3 is maintained in an open state. A signal of, for example, 0 V (third voltage signal) is input to the input port ADC1 of the controller 300. A signal of, for example, 3.3 V (fourth voltage signal) is input to the input port ADC2 of the controller 300. The controller 300 controls the locking unit to lock the inlet shutter 14 in the inlet position. For example, the controller 300 drives the electric motor 182, based on a detection signal received from the sensor 185, such that the first cam portion 181*a*-1 of the rotational cam 181 faces the moving member 183 again. Then, as illustrated in FIG. 9, the latch member 16 is moved to the first position where the latching protrusion 161 is caught by the second latching portion 145 via an elastic force of the latch spring 17, thereby locking the inlet shutter 14 in the inlet position.

In this state, by pressing the plunger 93, toner may be refilled in the toner container 230 through the toner refilling portion 10. When the toner cartridge 9 is rotated about the first rotational axis C1 such that the inlet shutter 14 deviates from the blocking position, the protruding portion 912 is located in a lower portion of a boundary of the insertion portion 135 of the upper body 13. In this state, even when attempting to separate the toner cartridge 9 from the mounting portion 11, since the protruding portion 912 is caught by the boundary of the insertion portion 135, the toner cartridge 9 is not separated. To separate the toner cartridge 9 from the mounting portion 11, the toner cartridge 9 is to be rotated in a second direction which is opposite to the first direction. However, since the inlet shutter 14 is locked in the inlet position, the toner cartridge 9 is not rotated in the second direction. Thus, abnormal removal of the toner cartridge 9 from the mounting portion 11 may be prevented, and stable toner refilling may be performed.

When the plunger 93 reaches the bottom dead position Q2, toner filling is completed. Whether toner filling is completed is detected by using the toner filling completion detection sensor 92. When the plunger 93 reaches the bottom dead position Q2, the pushing protrusion 931 pushes the operating lever 923 to bring the pair of electrodes 921 and 922 into contact with each other. The third switch SW3 is in a closed state. The first switch SW1 and the second switch SW2 are in a closed state. A signal of, for example, 0 V (third voltage signal) is input to the input port ADC1 of the controller 300. A signal of, for example, 0 V (fifth voltage signal) is input to the input port ADC2 of the controller 300. The controller 300 controls the locking unit to unlock locking of the inlet shutter 14 such that the inlet shutter 14 is rotated together with the toner cartridge 9. For example, the controller 300 drives the electric motor 182, based on a detection signal received from the sensor 185, such that the second cam portion 181*a*-2 of the rotational cam 181 faces the moving member 183 again. Then, as illustrated in FIG. 10, the latch member 16 is moved in an opposite direction to an elastic force of the latch spring 17 via the moving member 183 so that the latching protrusion 161 deviates from the second latching portion 145 to be in the second position where rotation of the inlet shutter 14 is allowed. Then the toner cartridge 9 is in a state where it is rotatable in the second direction to be removed.

Next, to remove the toner cartridge 9, the toner cartridge 9 may be rotated in the second direction, for example, by 180 degrees. Then, the inlet shutter 14 returns to the blocking position as illustrated in FIG. 7. When interference between the contact protrusion 144-2 and the electrode 148-1 ends, the pair of electrodes 148-1 and 148-2 are spaced apart from each other, and the second switch SW2 is in an open state. The third switch SW3 is maintained in a closed state. A signal of, for example, 1.65 V (second voltage signal) is input to the input port ADC1 of the controller 300. A signal of, for example, 0 V (fifth voltage signal) is input to the input port ADC2 of the controller 300. After it is detected that toner filling has been completed, when the inlet shutter 14 is detected to be no longer in the inlet position, the controller 300 remains on standby until the toner cartridge 9 is separated from the mounting portion 11. That is, the controller 300 waits until the first switch SW1 is in an open state. When the toner cartridge 9 is rotated in the second direction by 180 degrees, the inlet shutter 14 reaches the blocking position. In this state, the toner cartridge 9 is separated from the mounting portion 11. Then the first switch SW1 is in an open state, and a signal of, for example, 3.3 V (first voltage signal) is input to the input port ADC1 of the controller 300. The controller 300 controls the locking unit to lock the inlet shutter 14 in the blocking position. For example, the controller 300 drives the electric motor 182 based on a detection signal received from the sensor 185 such that the first cam portion 181*a*-1 of the rotational cam 181 faces the moving member 183 again. Then, as illustrated in FIG. 9, the latch member 16 is moved to the first position where the latching protrusion 161 is caught by the first latching portion 144 via an elastic force of the latch spring 17, thereby locking the inlet shutter 14 in the blocking position.

While examples have been described with reference to the figures, it will be understood by those of ordinary skill in the art that various changes in form and details may be made therein without departing from the spirit and scope as defined by the following claims.

What is claimed is:

1. A printer comprising:

a main body;

a development cartridge attachable to and detachable from the main body, the development cartridge to supply toner contained in a toner container to an electrostatic latent image formed on a photoconductor, to form a visible toner image;

a mounting portion comprising a toner inlet portion connected to the toner container, wherein a toner cartridge usable to refill toner in the toner container is mountable to the mounting portion;

an inlet shutter rotatably provided in the mounting portion to be rotatable together with the toner cartridge, the inlet shutter to be rotatable between a blocking position to block the toner inlet portion from receiving toner and an inlet position to open the toner inlet portion to receive toner;

a locking unit to selectively lock and unlock the inlet shutter; and a controller to control the locking unit to selectively lock and unlock the inlet shutter based on whether the toner cartridge is mounted to the mounting portion.

2. The printer of claim 1, comprising a second electrical contact provided in the mounting portion and electrically connectable to a first electrical contact provided in the toner cartridge when the toner cartridge is mounted in the mounting portion, wherein the controller is connected to the second electrical contact, to detect whether the toner cartridge is mounted in the mounting portion based on whether the first electrical contact and the second electrical contact are electrically connected.

3. The printer of claim 2, wherein the controller is to:

control the locking unit to lock the inlet shutter in the blocking position when mounting of the toner cartridge is not detected, and control the locking unit to unlock the inlet shutter when mounting of the toner cartridge is detected.

4. The printer of claim 1, comprising a rotation detection sensor provided in the mounting portion to detect whether the inlet shutter has reached the inlet position, wherein the controller is to control the locking unit to lock the inlet shutter in the inlet position when the rotation detection sensor detects that the inlet shutter has reached the inlet position.

5. The printer of claim 4, wherein the rotation detection sensor comprises electrodes to provide an electrical connection state that is to vary as the inlet shutter reaches the inlet position.

6. The printer of claim 5, wherein the electrodes comprise:

a fixed electrode, and a spring electrode to elastically contact or be separated from the fixed electrode, wherein a contact protrusion provided in the inlet shutter to interfere with the spring electrode to bring the fixed electrode and the spring electrode into contact with each other when the inlet shutter reaches the inlet position.

7. The printer of claim 4, comprising an electrical contact through which toner filling completion is detectable, the electrical contact provided in the mounting portion and to be connected to a toner filling completion detection sensor, wherein the controller is to control the locking unit to unlock the inlet shutter when the toner filling completion is detected through the electrical contact.

8. The printer of claim 7, wherein the controller is to control the locking unit to lock the inlet shutter when mounting of the toner cartridge to the mounting portion is not detected and the toner filling completion is detected.

9. A printer comprising:

a main body including a communicating portion;

a development cartridge attachable to and detachable from the main body, the development cartridge to supply toner contained in a toner container to an electrostatic latent image formed on a photoconductor, to form a visible toner image;

a toner refilling portion comprising:

a toner inlet portion connected to the toner container, a mounting portion to receive a toner cartridge insertable from outside of the main body through the communicating portion to be mounted to the mounting portion, an inlet shutter, with the toner cartridge rotating, rotatable between a blocking position to block the toner inlet portion from receiving toner and an inlet position to open the toner inlet portion to receive toner, and an electrical contact portion electrically connectable to the toner cartridge, through which an electrical signal is inputtable;

a locking unit to selectively lock and unlock the inlet shutter; and a controller to control the locking unit to lock and unlock the inlet shutter based on the electrical signal input through the electrical contact portion.

10. The printer of claim 9, wherein the electrical contact portion comprises a second electrical contact, wherein, when the toner cartridge is mounted to the mounting portion, the second electrical contact is electrically connected to a first electrical contact provided in the toner cartridge, wherein the controller is to control the locking unit to unlock the inlet shutter when the second electrical contact being electrically connected to the first electrical contact is detected.

11. The printer of claim 10, comprising a rotation detection sensor connected to the electrical contact portion, to detect whether the inlet shutter has reached the inlet position, wherein the controller is to control the locking unit to lock the inlet shutter in the inlet position when the rotation detection sensor detects that the inlet shutter has reached the inlet position.

12. The printer of claim 11, wherein the rotation detection sensor comprises:

a fixed electrode, and a spring electrode to elastically contact or be separated from the fixed electrode, wherein a contact protrusion provided in the inlet shutter to interfere with the spring electrode to bring the fixed electrode and the spring electrode into contact with each other when the inlet shutter reaches the inlet position.

13. The printer of claim 11, wherein the electrical contact portion comprises an electrical contact through which a toner filling completion signal is receivable to detect toner filling completion, wherein the controller is to control the locking unit to unlock the inlet shutter when the toner filling completion signal is detected through the electrical contact.

14. The printer of claim 13, wherein the controller is to control the locking unit to lock the inlet shutter when mounting of the toner cartridge in the mounting portion is not detected after the toner filling completion signal is detected.

15. The printer of claim 9, wherein the toner refilling portion is integrated with the development cartridge.

* * * * *